United States Patent [19]

Heltzel

[11] Patent Number: 4,563,827

[45] Date of Patent: Jan. 14, 1986

[54] SAFETY SYSTEM FOR DISABLING A FIREARM

[76] Inventor: James Heltzel, Rte. 1, Box 351, Mauertown, Va. 22644

[21] Appl. No.: 589,543

[22] Filed: Mar. 14, 1984

[51] Int. Cl.[4] ..... F41C 17/00

[52] U.S. Cl. ..... 42/70 R; 42/1 LP

[58] Field of Search ..... 42/70 R, 84, 1 R, 1 LP, 42/1 MH; 89/28.05, 135, 136

[56] References Cited

U.S. PATENT DOCUMENTS

| | | | |
|---|---|---|---|
| 2,472,136 | 6/1949 | Whitlock | 89/28.05 |
| 3,400,393 | 9/1968 | Ash | 42/1 R |
| 3,831,065 | 8/1974 | Martin et al. | 361/172 |
| 4,003,152 | 1/1977 | Barker et al. | 42/70 R |
| 4,205,589 | 6/1980 | Engler et al. | 42/84 |
| 4,457,091 | 7/1984 | Wallerstein | 42/70 R |

*Primary Examiner*—Charles T. Jordan
*Assistant Examiner*—Ted L. Parr
*Attorney, Agent, or Firm*—Larson and Taylor

[57] ABSTRACT

A safety system for selectively disabling a firearm which is fired by a mechanical movement is disclosed. The safety system includes a block which is moved between an engaged position whereby the mechanical firing movement is blocked and a disengaged position whereby the mechanical firing movement is not blocked. The block has a bearing surface which engages a relatively immovable part of the firearm when the block is in the engaged position. A moving device is also provided for moving the block from the disengaged position to the engaged position, with the moving device normally biasing the block to the disengaged position. A remotely controlled actuating device for actuating the moving device includes a transmitter which selectively transmits a signal and which is designed to be carried by the operator of the firearm. A receiver is located adjacent the moving device. The receiver receives the signal from the transmitter and operates the moving device. Where the mechanical movement includes a member which moves parallel to a metal surface, the block is an elongate bar which is extendable through an aperture in the metal surface. The block can also be a lever which is pivoted intermediate two opposed ends. Conveniently, the moving device is a solenoid.

12 Claims, 6 Drawing Figures

SAFETY SYSTEM FOR DISABLING A FIREARM

FIELD OF THE INVENTION

The present invention relates generally to a safety system for a firearm, and more particularly to a safety system for selectively disabling a firearm by use of a remote transmitter.

BACKGROUND OF THE INVENTION

A number of prior art devices have been disclosed which relate to safety systems for firearms. For example, in U.S. Pat. No. 4,003,152 (Barker et al) a safety system is described in which a firearm is normally disabled. The firearm is enabled only when a coded signal is transmitted by an authorized person. In U.S. Pat. No. 3,400,393 (Ash), a weapon safety system is disclosed in which an electromagnetic wave transceiver is mounted on a number of weapons. Each weapon is disabled if it is pointed at and detects identical electromagnetic waves transmitted by another weapon with the same transceiver. If no identical electromagnetic wave is received, the weapon is functional. A similar safety system is disclosed in U.S. Pat. No. 2,472,136 (Whitlock). A safety system in which a plurality of weapons can fire only when the weapon trigger is depressed and a specific command signal is received by the weapon is disclosed in U.S. Pat. No. 4,205,589 (Engler et al).

SUMMARY OF THE INVENTION

In accordance with the present invention, a safety system for selectively disabling a firearm which is fired by a mechanical movement is provided. The safety system includes a block which is moved between an engaged position whereby the mechanical firing movement is blocked and a disengaged position whereby the mechanical firing movement is not blocked. The block includes a bearing surface which engages a relatively immovable part of the firearm when the block is in the engaged position to positively prevent the mechanical firing movement from operating. A moving means is further provided for moving the block from the disengaged position to the engaged position. Normally, the moving means biases the block in the disengaged position. A remotely controlled actuating means is also provided for actuating the moving means. The actuating means includes a transmitter means which selectively transmits a signal and which is designed to be carried by the operator of the firearm. A receiving means is located adjacent the moving means in the firearm for receiving the signal from the transmitter means and for operating the moving means.

In one preferred embodiment of the present invention, the mechanical movement includes a member which moves parallel to a metal surface. The block is then an elongate bar which is extendable through an aperture in the metal surface to prevent the member from moving along the metal surface. Conveniently, the member is the hammer of the firearm and the bar extends perpendicular to the metal surface.

In another preferred embodiment of the present invention, the block is a lever which is pivoted intermediate two opposed ends. When the lever is in the engaged position, one end engages the mechanical firing movement while the other end is the bearing surface which engages a relatively immovable part of the firearm.

Conveniently, the one end of the lever engages a hammer of the firearm or the rebound slide member.

In still another embodiment of the present invention, the mechanical movement includes a reciprocating member and the block is a stop which is movable into the path of the reciprocating member.

In the preferred embodiments of the present invention, the moving means for the block is a solenoid which is remotely actuated by a transmitter.

Preferably, the transmitter is designed to be easily activated by a push button. If desired, the transmitter is additionally provided with a plurality of push buttons which must be pushed in a predetermined sequence to turn off the transmitter after the transmitter has been activated.

It is an object of the present invention to provide a safety system for disabling a firearm when desired. The safety system is normally biased to the disengaged position so that only a positive actuation of the transmittor results in the firearm being disabled.

It is another object of the present invention to provide a safety system in which any malfunction in the transmitter, receiver, or moving means for the block still allows the weapon to operate in the normal manner and not be disabled.

It is a feature of the present invention that the safety system requires only a very low energy consumption, especially when the safety system is not activated.

Other objects, features, and advantages of the present invention are stated in or apparent from a detailed description of presently preferred embodiments of the invention found hereinbelow.

DETAILED DESCRIPTION OF THE PREFERRED EMBODIMENTS

Figure 1A:
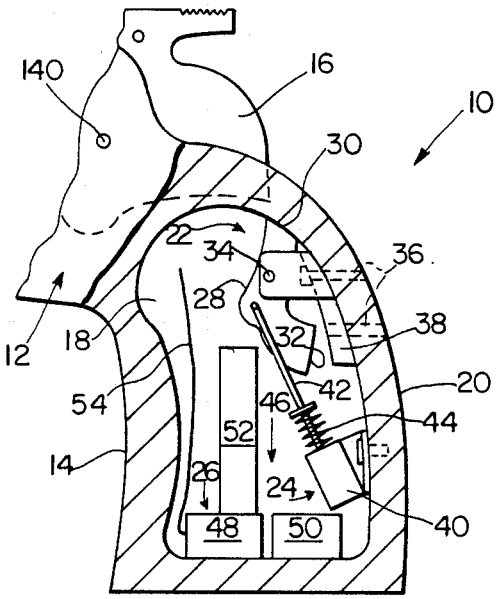
FIGS. 1*a* and 1*b* are side elevation views in partial cross section of a first embodiment of a safety system according to the present invention depicting the handle portion of a firearm with the safety system deactivated and activated, respectively.
Figure 1B:
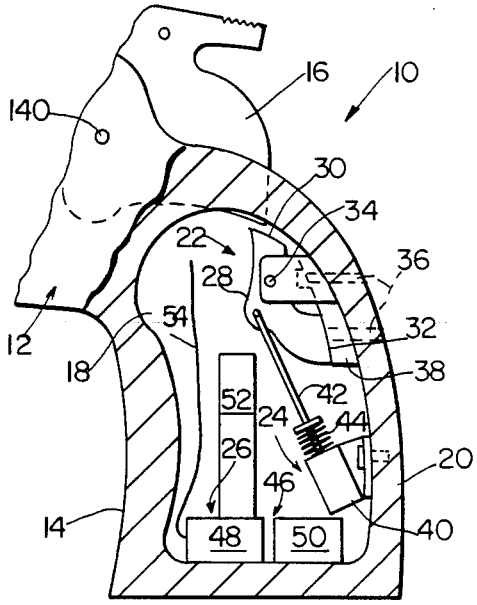

With reference now to the drawings in which like numerals represent like element throughout the several views, a first preferred embodiment of a safety system 10 is depicted in FIGS. 1*a* and 1*b*. Safety system 10 is incorporated in a revolver 12 of which only the handle portion 14 is depicted. As shown, revolver 12 includes a hammer 16 which is used to fire revolver 12. Handle portion 14 includes a hollow space 18 beneath the cover plate (not shown) normally provided on handle portion 14. It should be appreciated that the area of handle portion 14 which is shown in cross section is the metal frame 20 of the revolver.

Located in hollow space 18 is a block 22, a moving means 24, and part of a remotely controlled actuating means 26. In this embodiment, block 22 is in the form of a lever 28 which has a blocking end 30 and a bearing end 32. As shown, lever 28 is pivoted intermediate the two ends 30 and 32 about a pivot pin 34. Lever 28 is conveniently attached to frame 20 by means of screws 36 in a base 38.

Moving means 24 includes a solenoid 40 which is attached to frame 20. Solenoid 40 includes a movable arm 42 which is pivotably attached to lever 28. A spring 44 normally biases arm 42 outwardly of solenoid 40 so that lever 28 is normally located in the position depicted in FIG. 1 until solenoid 40 is energized.

The portion of actuating means 26 located in hollow space 18 is receiver 46. Receiver 46 includes a receiving module 48, a decoder 50, and a battery 52. Battery 52 powers receiving module 48 and decoder 50 and also provides actuating power for solenoid 40. Receiver 46 is also depicted schematically in FIG. 4. Preferably, receiving module 48 also includes an antenna 54.

Figure 4:
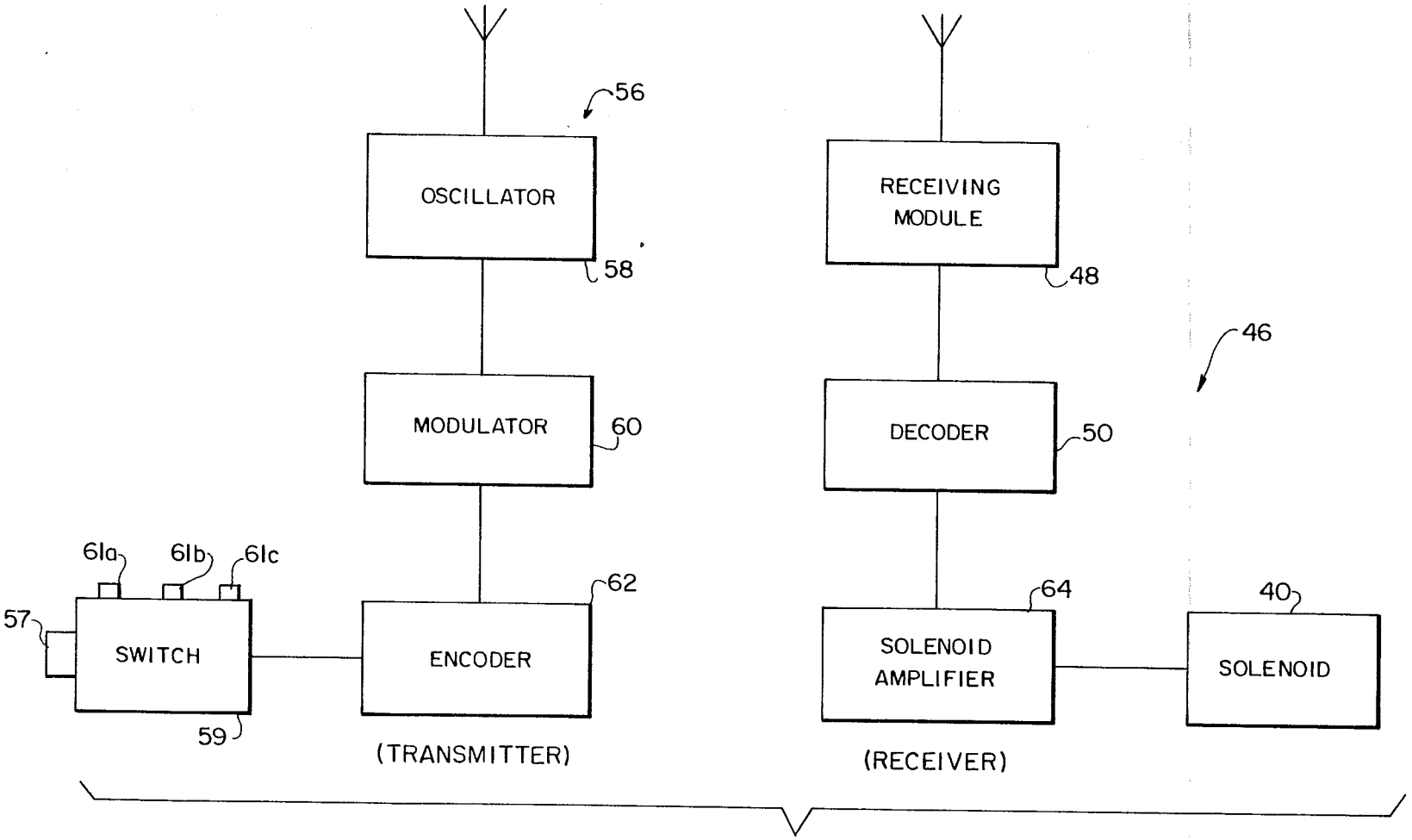
FIG. 4 is a schematic diagram of the transmitter and receiver units used with the safety system of the present invention.

Actuating means 26 also includes a transmitter 56 which is schematically depicted in FIG. 4. Transmitter 56 is designed to be carried by the operator of the revolver 12 and to include a simple push button 57 to actuate switch 59 of transmitter 56. As shown in FIG. 4, transmitter 56 includes an oscillator 58, a modulator 60 and an encoder 62. With these components, transmitter 56 transmits a suitable encoded signal upon activation which is suitably received by receiver 46 and decoded to actuate solenoid 40.

If desired, switch 59 is also provided with a plurality of push buttons 61*a*, 61*b* and 61*c* which constitute a keyed lock means. Push buttons 61*a*, 61*b* and 61*c* are suitably connected to a switching circuit so that transmitter 56 cannot be deactivated after an initial actuation by push button 57 until push buttons 61*a*, 61*b* and 61*c* are sequentially pressed or keyed in a predetermined sequence. A push button unlocking a circuit of this type is well known in the art and a circuit of this type is disclosed in U.S. Pat. No. 3,831,065 (Martin et al).

In operation, safety system 10 in revolver 12 functions in the following manner. Initially, safety system 10 is in a position depicted in FIG. 1*a*. In this position, hammer 16 is free to move in the normal manner and fire revolver 12. Receiver 46 is also energized by battery 52 so that receiving module 48 is capable of receiving a signal from transmitter 56 at all times. It should be appreciated that the energy required to maintain receiving module 48 in the "ready" condition is relatively small and that a rechargeable battery would be a suitable power source. Preferably, the weapon would be provided with a suitable circuit and plug-in charging device so that the battery could be easily and regularly recharged by simply plugging the weapon in the charging device.

When it is desired to activate safety system 10, as for example when revolver 12 belongs to a police officer and an unauthorized user has gained control of revolver 12, the police officer merely presses the push button on transmitter 56. Preferably, transmitter 56 is carried by the police officer in such a position as to be easily actuated by the police officer. As soon as transmitter 56 is actuated, an encoded signal is sent by transmitter 56 to receiver 46 and decoded by decoder 50. A signal from decoder 50 is then sent to solenoid amplifier 64 which in turn energizes solenoid 40. As soon as solenoid 40 is energized, arm 42 is withdrawn into solenoid 40 against the force of spring 44. This causes lever 28 to pivot about pivot pin 34 until bearing surface 32 bears directly against base 38 and frame 20. At the same time, blocking end 30 pivots into a position to intercept the lower end of hammer 16 and thereby prevent hammer 16 from cocking and firing revolver 12. It should be appreciated that the force applied to blocking end 30 is transmitted through lever 28 to bearing end 32 so that the force is exerted directly against frame 20 which represents a relatively immovable portion of revolver 12. Therefore, it is very unlikely that lever 28 can be forceably broken to allow revolver 12 to fire.

As long as transmitter 56 is activated, lever 28 remains in the blocking position depicted in FIG. 1*b*. Moreover, as soon as the police officer retrieves his revolver 12, transmitter 56 is immediately deactivated by the officer (if desired) by pushing buttons 61*a*, 61*b* and 61*c* in the necessary sequence to allow revolver 12 to again operate. When transmitter 56 is turned off, lever 28 immediately pivots back to the position depicted in FIG. 1*a* due to the force exerted by spring 44 against arm 42. At this time, safety system 10 is again capable of being actuated as soon as desired. If safety system 10 is actuated for a long period of time, battery 52 should be recharged or replaced as appropriate.

It should be appreciated that safety system 10 is designed to be retrofitted to existing revolvers 12. In addition, it should also be appreciated that the elements of safety system 10 must be designed to fit in hollow space 18 of revolver 12 and to intercept hammer 16 appropriately.

Figure 2B:
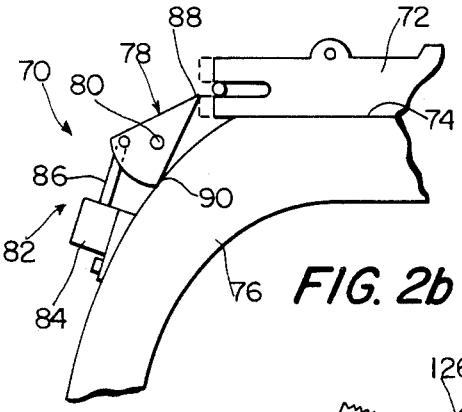
FIGS. 2*a* and 2*b* are side elevation views of a portion of a firearm including the rebound slide member of the mechanical firing movement and a block for the rebound slide depicted in the disengaged and engaged position, respectively.
Figure 2A:
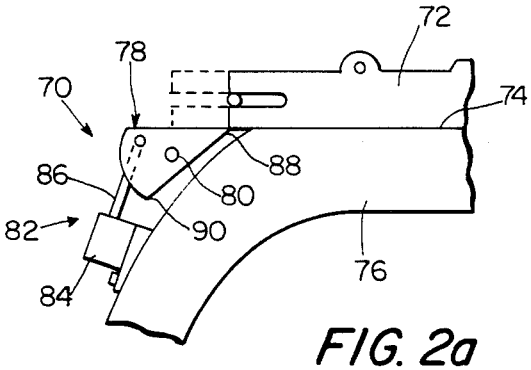

Depicted in FIGS. 2*a* and 2*b* is an alternative embodiment of a block 70 according to the present invention. Block 70 is designed to prevent the operation of rebound slide member 72 as rebound slide member 72 moves along surface 74 of frame 76 during the cocking action of the hammer. Block 70 includes a wedge-shaped member 78 which is pivotally attached about a pivot pin 80.

Wedge-shaped member 78 is moved into and out of an engaged position with rebound slide member 72 by a moving means 82. Moving means 82 includes a solenoid 84 and an arm 86 which is attached to wedge-shaped member 78 as shown. As with solenoid 40, solenoid 84 is biased so that arm 86 is normally maintained in a position where wedge-shaped member 78 does not engage rebound slide member 72. This position is shown in FIG. 2*a*. In this embodiment, arm 86 is normally maintained in the withdrawn position relative to solenoid 84.

In operation, block 70 functions in the following manner. Initially, wedge-shaped member 78 is maintained in the position depicted in FIG. 2*a* whereby rebound slide member 72 is free to move parallel to surface 74 as depicted in the dotted lines so that the hammer of the revolver is free to be cocked. When moving means 82 is actuated by an actuating means such as actuating means 26 described above, arm 86 is drawn into solenoid 84 when solenoid 84 is energized. When this occurs, wedge-shaped member 78 pivots about pivot pin 80 so that tip 88 of wedge-shaped member 78 blocks the path of rebound slide member 72. It should also be noted that bearing surface 90 of wedge-shaped member 78 rests against a portion of frame 76 so that any force exerted against tip 88 by rebound slide member 72 is resisted by frame 76 as depicted in FIG. 2*b*.

Figure 3:
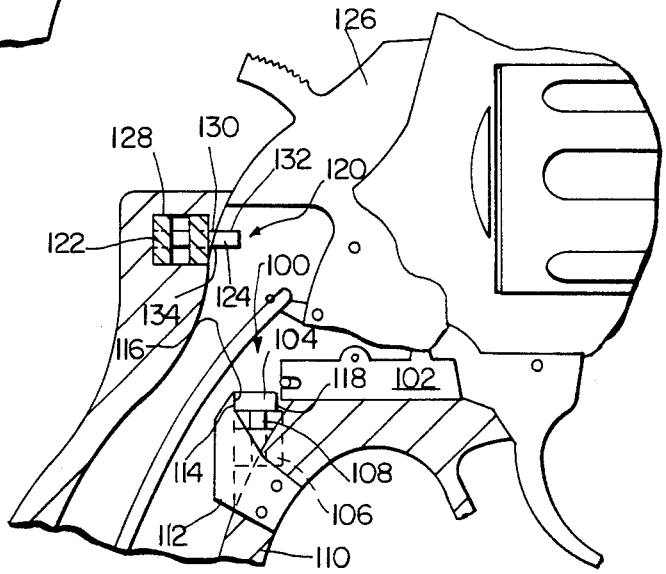
FIG. 3 is a side elevation view in partial cross section of a firearm containing two additional alternative embodiments of a safety system according to the present invention.

Depicted in FIG. 3 is a third embodiment of a safety system in accordance with the present invention which includes a block 100. Block 100 is used to prevent the operation of a rebound slide member 102. In this embodiment, block 100 is a stop 104 which is movable into and out of an engaged position by solenoid 106. Stop 104 is directly attached to arm 108 extending from solenoid 106. Solenoid 106 is attached to frame 110 by a bracket 112 which includes a stop surface 114. Stop 104 includes a bearing end 116 and a blocking end 118.

In operation, block 100 functions in the following manner. Initially, arm 108 is positioned in solenoid 106 so that stop 104 does not interfere with the sliding operation of rebound slide member 102. However, when solenoid 106 is energized in a suitable manner such as activating means 26 described above, arm 108 is withdrawn from solenoid 106 causing stop 104 to be positioned between rebound slide member 102 and stop surface 114 of bracket 112. This is the position depicted in FIG. 3. When this occurs, rebound slide member 102 contacts blocking end 118 of stop 104 when rebound slide member 102 attempts to move in the cocking of the hammer of the revolver. When rebound slide member 102 contacts blocking end 118, bearing end 116 bears against stop surface 114 of bracket 112 preventing any further movement of rebound slide member 102. As with the other embodiments, the force exerted by rebound slide member 102 is ultimately exerted against frame 110 which is sufficient to resist any such force.

Also depicted in FIG. 3 is a fourth embodiment of the present invention including a block 120 and a solenoid 122. In this embodiment, block 120 forms a part of arm 124 which extends out of solenoid 122. In this embodiment, block 120 is designed to prevent hammer 126 from cocking.

This embodiment of the present invention is designed to be incorporated in revolver during manufacture thereof. Thus, solenoid 122 is located in a cavity 128 provided in frame 110. In addition, arm 124 extends through an aperture 130 provided in frame 110. Thus, block 120 includes a blocking surface 132 which engages hammer 126 and a bearing surface 134 located in aperture 130 which engages frame 110.

In operation, block 120 functions in the following manner which is similar to the operation of the previously described blocks. Thus, solenoid 122 is normally in the unenergized state whereby arm 124 and hence block 120 is positioned fully inside of solenoid 122. In this position, hammer 126 is free to cock and move past aperture 130. When a suitable transmitter is activated and a suitable receiver detects a signal and energizes solenoid 122, arm 124 is pushed out of solenoid 122 through aperture 130. This causes block 120, which is part of arm 124, to move beyond aperture 130 into the path normally traversed by hammer 126 in cocking. Thus, if hammer 126 is moved in a cocking motion, the end of hammer 126 adjacent block 120 contacts blocking surface 132. When this occurs, bearing surface 134 presses against frame 110 positively preventing hammer 126 from cocking. It should be appreciated that the force exerted by hammer 126 in attempting to cock hammer 126 is resisted by frame 110 as bearing surface 134 engages that portion of frame 110 around aperture 130.

It should be appreciated that the safety systems described above are all designed to allow the weapon to operate should any component of the safety system fail. In addition, an easily concealed transmitter is provided whereby the user need be the only one to know that a safety system is installed in the associated weapon. Thus, if the user should inadvertently lose his weapon, the unauthorized person who .retrieves the weapon would not immediately realize that the weapon was not capable of firing and would also not realize why the weapon was not capable of firing.

It should further be appreciated that the safety system of the present invention allows the weapon to be reactivated at the discretion of the user and only an authorized user where a keyed code switch is used. In addition, by use of a coded signal, only a specific transmitter transmitting a specified control signal will operate to inactivate the weapon. The use of a solenoid also allows the operation of the safety system to be checked by merely activating the system and listening for the click of the solenoid action to indicate that the safety system is functioning properly.

When the safety systems described above are used with the firearms of a police force, the transmitter can also be adapted to notify a controller that an officer has found it necessary to deactivate his weapon and that a potentially dangerous situation has occurred. In this manner, help can be immediately sent.

If desired, an indicator on the weapon can also be provided to indicate when the safety system is engaged and use of the weapon is not possible. A small light or a discreet audio signal are suitable such indicators.

Although the present invention has been described with the use of a radio transmitter and receiver, it should be appreciated that other types of transmitters and receivers are possible. For example, sonic, ultrasonic, and voice activated transmitters and receivers would also be possible.

In order to further conserve the battery power which is used to power the receiver, a switch can be provided whereby the receiver is only powered to receive to a transmitted signal when the switch is on. Such a switch could be manually activated whenever the user had cause for concern that an unauthorized person might gain control of his weapon. Alternatively, a switch could be provided which would only power the receiver when the weapon is removed from a holster. A light switch, magnetic switch, spring loaded push out switch or other holster activated switch would be suitable for this purpose such as switch 140 shown in FIGS. 1*a* and 1*b*. Preferably, such a cut-off switch, once activated to supply power, would maintain the power for a set period of time so that no accidental or undesired return of the switch to the non-power delivering state would immediately cause the receiver to stop functioning.

Other suitable switches could be actuated by the position of the weapon. Thus, when the barrel is not vertically oriented, that is pointed to the ground as normally occurs when a weapon is carried in a holster or the like, the receiver would not be powered. Suitable switches of this type include magnetic and mercury position switches. A timed switch could also be activated when the user carries the weapon. In such a case, the timed switch would be actuated for a period sufficient to cover the time period in which the user carries the weapon in a dangerous situation, such as the shift of a police officer.

Although the present invention has been described with solenoids which immediately return to the inactivated position when no signal is received, it would also be possible to provide latching solenoids of the type that once activated the solenoids would maintain the block in the position to prevent use of the weapon even when the transmitted signal is no longer received. If this type of permanent block weapon is desired, the solenoid could also be replaced by a fused link or other electromechanical device to permanently deactivate a weapon.

Thus, while the present invention has been described with respect to exemplary embodiments thereof, it will be understood by those of ordinary skill in the art that variations and modifications can be effected within the scope and spirit of the invention.

I claim:

1. A safety system for selectively disabling a firearm which is fired by a mechanical movement comprising:

a block which is moved between an engaged position whereby the mechanical firing movement is blocked and a disengaged position whereby the mechanical firing movement is not blocked, said block having a bearing surface which engages a relatively immovable part of the firearm when said block is in the engaged position to positively prevent the mechanical firing movement from operating;

a moving means for moving said block from the disengaged position to the engaged position, said moving means being normally biased to move said block to and hold said block in the disengaged position; and a remotely controlled actuating means for actuating said moving means including (a) a transmitter means for selectively transmitting a signal, said transmitter means being designed to be carried by the operator of the firearm, and (b) a receiver means located adjacent said moving means for receiving the signal from said transmitter means and for operating said moving means.

2. A safety system as claimed in claim 1 wherein the mechanical movement includes a member which moves parallel to a metal surface; and wherein said block is an elongate bar which is extendable through an aperture in the metal surface to prevent the member from moving along the metal surface.

3. A safety system as claimed in claim 2 wherein the member is the hammer of the firearm and said bar extends perpendicular to the metal surface.

4. A safety system as claimed in claim 3 wherein said moving means is a solenoid.

5. A safety system as claimed in claim 1 wherein said block is a lever which is pivoted intermediate two opposed ends such that when said lever is in the engaged position one end engages the mechanical firing movement while the other end is said bearing surface.

6. A safety system as claimed in claim 5 wherein said one end of said lever engages a hammer of the firearm.

7. A safety system as claimed in claim 5 wherein said one end of said lever engages a rebound slide member of the mechanical firing movement.

8. A safety system as claimed in claim 5 wherein said moving means is a solenoid.

9. A safety system as claimed in claim 1 wherein the mechanical movement includes a reciprocating member, and wherein said block is a stop which is movable into the path of the reciprocating member.

10. A safety system as claimed in claim 1 wherein said actuating means includes a switch means which is easily actuated to activate said transmitter, said switch means including a keyed lock means for locking said transmitter in the activated condition until said keyed lock means is deactivated.

11. A safety system as claimed in claim 10 wherein said keyed lock means includes a plurality of push buttons which must be keyed in a predetermined sequence to deactivate said trans- mitter.

12. A safety system as claimed in claim 1 wherein said receiver means includes a cut-off switch for a battery which powers said receiver means.

* * * * *